US010066589B2

(12) United States Patent
Chittoor et al.

(10) Patent No.: US 10,066,589 B2
(45) Date of Patent: Sep. 4, 2018

(54) INDEPENDENT INTAKE RUNNER RESONATOR SYSTEM

(71) Applicants: Sairam Chittoor, Auburn Hills, MI (US); Fadi Estefanous, Warren, MI (US); Lurun Zhong, Troy, MI (US)

(72) Inventors: Sairam Chittoor, Auburn Hills, MI (US); Fadi Estefanous, Warren, MI (US); Lurun Zhong, Troy, MI (US)

(73) Assignee: FCA US LLC, Auburn Hills, MI (US)

( * ) Notice: Subject to any disclaimer, the term of this patent is extended or adjusted under 35 U.S.C. 154(b) by 52 days.

(21) Appl. No.: 15/428,632

(22) Filed: Feb. 9, 2017

(65) Prior Publication Data

US 2018/0223778 A1 Aug. 9, 2018

(51) Int. Cl.

*F02M 35/104* (2006.01)
*F02M 35/12* (2006.01)
*F02M 35/10* (2006.01)

(52) U.S. Cl.

CPC ..... *F02M 35/1266* (2013.01); *F02M 35/104* (2013.01); *F02M 35/10026* (2013.01); *F02M 35/10072* (2013.01); *F02M 35/10085* (2013.01); *F02M 35/10255* (2013.01)

(58) Field of Classification Search

CPC ..... F02M 5/104; F02M 35/10026; F02M 35/10072; F02M 35/10085; F02M 35/10255; F02M 35/1266

USPC ..... 123/184.53, 184.57

See application file for complete search history.

(56) References Cited

U.S. PATENT DOCUMENTS

| | | | | |
|---|---|---|---|---|
| 5,377,629 | A | 1/1995 | Brackett et al. | |
| 5,792,247 | A | 8/1998 | Gillingham et al. | |
| 6,758,304 | B1 * | 7/2004 | McLean | F02M 35/125 123/184.57 |
| 7,077,093 | B2 * | 7/2006 | Koelmel | F02B 27/02 123/184.24 |
| 7,497,196 | B2 | 3/2009 | Prior | |
| 7,503,303 | B2 * | 3/2009 | Morita | F02B 27/021 123/184.53 |
| 7,556,010 | B2 | 7/2009 | Egawa et al. | |
| 2008/0072863 | A1 | 3/2008 | Egawa et al. | |
| 2008/0135010 | A1 | 6/2008 | Prior | |

* cited by examiner

*Primary Examiner* — Marguerite McMahon
(74) *Attorney, Agent, or Firm* — Ralph E. Smith

(57) ABSTRACT

An air intake system includes a plurality of intake runners configured to supply intake air to the engine, and an independent resonator system operably associated with the plurality of intake runners and including a plurality of individual resonator assemblies. Each individual resonator assembly is fluidly coupled to one intake runner of the plurality of intake runners. The plurality of individual resonator assemblies is configured to interact with at least one of sound and pressure waves generated in the engine to reduce engine noise and/or increase engine torque.

20 Claims, 3 Drawing Sheets

INDEPENDENT INTAKE RUNNER RESONATOR SYSTEM

FIELD

The present application relates generally to internal combustion engines and, more particularly, to an intake runner resonator system for an internal combustion engine.

BACKGROUND

Some conventional vehicles include resonators to tune the manifold of a naturally aspirated internal combustion engine to reduce intake noise or increase torque output at a specific speed range. For example, a resonator may be used on an intake air pipe that communicates intake air to the engine. The intake air pipe is typically disposed upstream from the intake manifold and supplies intake air thereto. A typical resonator includes a resonance volume or chamber having an opening connected to the intake air pipe. Pressure waves generated by the engine components travel along the intake air pipe and the resulting acoustic pressure excites air within the opening, which reacts against the acoustic pressure within the resonance chamber. This produces an out-of-phase acoustic pressure at the intake air pipe to counteract the intake noise at resonance frequency. In this way, some of the engine noise is eliminated as the out-of-phase acoustic pressures in the intake air pipe cancel each other. However, such typical resonators require large volumes and are only effective over a narrow band of speed ranges. Accordingly, while such conventional resonators work for their intended purpose, it is desirable to provide an improved resonator system with improved engine performance, volumetric efficiency, and NVH.

SUMMARY

According to one example aspect of the invention, an air intake system for an internal combustion engine is provided. The air intake system includes a plurality of intake runners configured to supply intake air to the engine, and an independent resonator system operably associated with the plurality of intake runners and including a plurality of individual resonator assemblies. Each individual resonator assembly is fluidly coupled to one intake runner of the plurality of intake runners. The plurality of individual resonator assemblies is configured to interact with at least one of sound and pressure waves generated in the engine to reduce engine noise and/or increase engine torque.

In addition to the foregoing, the described air intake system may include one or more of the following features: wherein each individual resonator assembly is directly fluidly coupled to only one intake runner of the plurality of intake runners; wherein the plurality of individual resonator assemblies comprises a first set of individual resonator assemblies coupled to each intake runner of the plurality of intake runners, and a second set of individual resonator assemblies coupled to each intake runner of the plurality of intake runners, wherein the first set of individual resonator assemblies is configured to increase engine torque and/or reduce engine noise at a first range of engine speeds, and the second set of individual resonator assemblies is configured to increase engine torque and/or reduce engine noise at a second range of engine speeds that is different than the first range of engine speeds; a plenum chamber fluidly coupled to the plurality of intake runners and configured to supply the intake air thereto; an air intake passage fluidly coupled to the plenum chamber and configured to supply the intake air thereto.

In addition to the foregoing, the described air intake system may include one or more of the following features: wherein the plurality of individual resonator assemblies comprises a plurality of passive resonator assemblies; wherein each passive resonator assembly comprises a chamber portion having an outer wall defining an inner volume, and a neck portion fluidly coupled between the chamber portion and one intake runner of the plurality of intake runners; and wherein each intake runner of the plurality of intake runners is fluidly coupled to one passive resonator assembly of the plurality of passive resonator assemblies.

In addition to the foregoing, the described air intake system may include one or more of the following features: wherein the plurality of individual resonator assemblies comprises a plurality of active resonator assemblies; wherein each active resonator assembly comprises a chamber portion having an outer wall defining an inner volume, a neck portion fluidly coupled between the chamber portion and one intake runner of the plurality of intake runners, and a valve disposed within the neck portion and configured to move between a closed position preventing fluid communication between the intake runner and the chamber portion, and an open position enabling fluid communication between the intake runner and the chamber portion; and wherein each intake runner of the plurality of intake runners is fluidly coupled to one active resonator assembly of the plurality of active resonator assemblies.

In addition to the foregoing, the described air intake system may include one or more of the following features: wherein the plurality of individual resonator assemblies comprises an active lumped resonator assembly; wherein the active lumped resonator assembly comprises a plurality of active resonator assemblies fluidly coupled in series to each other, each active resonator assembly comprising a chamber portion having an outer wall defining an inner volume, a neck portion fluidly coupled between the chamber portion and one intake runner of the plurality of intake runners, and a valve disposed within the neck portion and configured to move between a closed position preventing fluid communication between the intake runner and the chamber portion, and an open position enabling fluid communication between the intake runner and the chamber portion, and wherein the inner volumes of adjacent active resonator assemblies are fluidly coupled; wherein the active lumped resonator assembly further comprises an active resonator valve disposed between adjacent active resonator assemblies and configured to move between a closed position preventing fluid communication between the inner volumes of the adjacent active resonator assemblies, and an open position enabling fluid communication between the inner volumes of the adjacent active resonator assemblies; and wherein each intake runner of the plurality of intake runners is fluidly coupled to one active resonator assembly of the plurality of active resonator assemblies.

In addition to the foregoing, the described air intake system may include one or more of the following features: wherein the plurality of individual resonator assemblies comprises a multi-volume active lumped resonator assembly; wherein the multi-volume active lumped resonator assembly comprises a plurality of active resonator assemblies fluidly coupled in series to each other, each active resonator assembly comprising a first chamber portion having a first outer wall defining a first inner volume, a second chamber portion having a second outer wall defining a second inner volume fluidly connected to the first inner volume, a multi-volume resonator valve disposed between the first inner volume and the second inner volume, the multi-volume resonator valve configured to move between a closed position preventing fluid communication between the first inner volume and the second inner volume, and an open position enabling fluid communication between the first inner volume and the second inner volume, a neck portion fluidly coupled between the first chamber portion and one intake runner of the plurality of intake runners, and an intake runner valve disposed within the neck portion and configured to move between a closed position preventing fluid communication between the intake runner and the first chamber portion, and an open position enabling fluid communication between the intake runner and the first chamber portion, and wherein the first inner volumes of adjacent active resonator assemblies are fluidly coupled; wherein the multi-volume active lumped resonator assembly further comprises an active resonator valve disposed between adjacent active resonator assemblies and configured to move between a closed position preventing fluid communication between the first inner volumes of the adjacent active resonator assemblies, and an open position enabling fluid communication between the first inner volumes of the adjacent active resonator assemblies; and wherein each intake runner of the plurality of intake runners is fluidly coupled to one active resonator assembly of the plurality of active resonator assemblies.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings references therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

Figure 1:
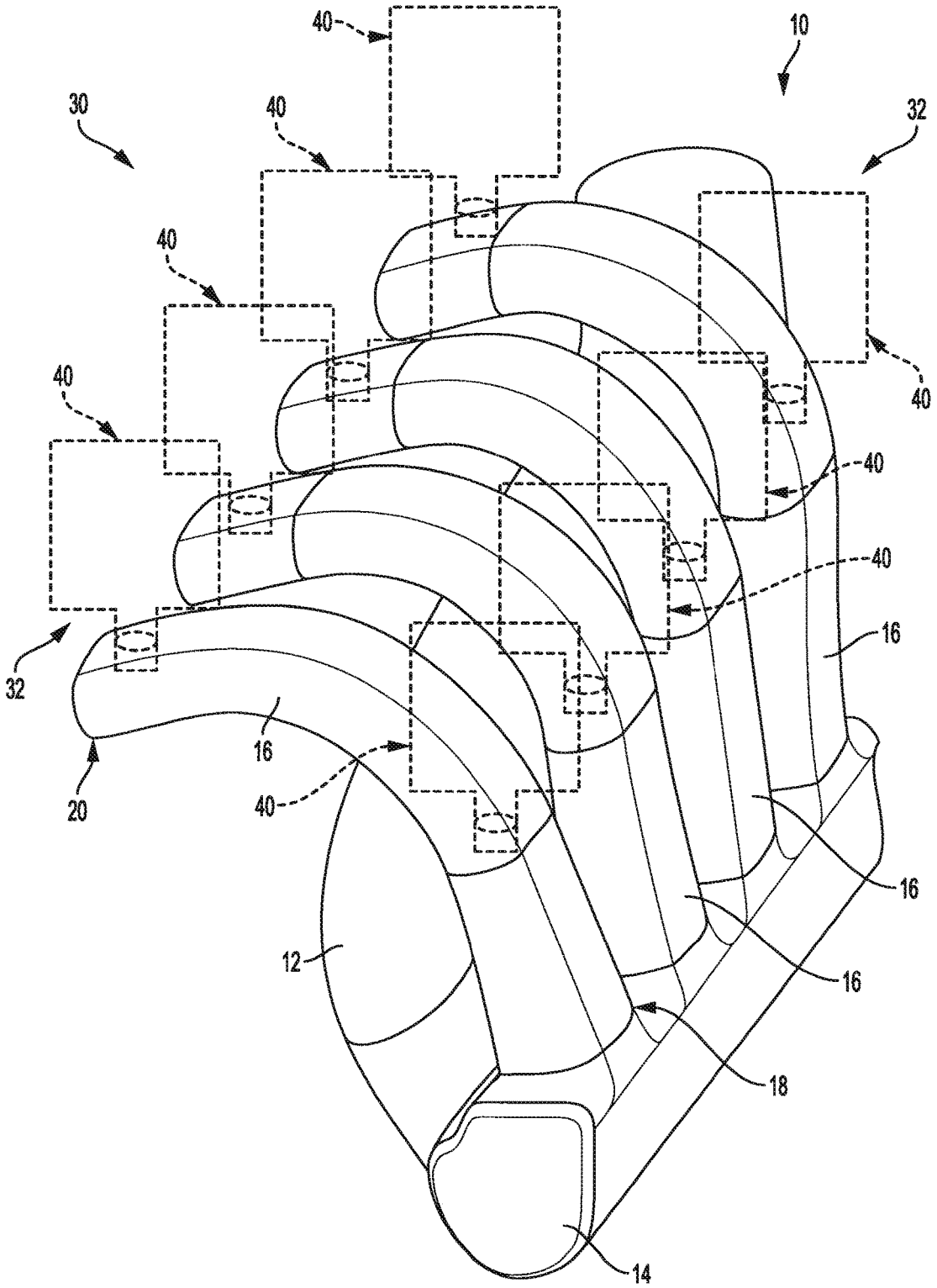
FIG. 1 is a partial schematic diagram of an example air intake system for an internal combustion engine, in accordance with the principles of the present disclosure.

With initial reference to FIG. 1, an example air intake system for an internal combustion engine is illustrated and generally identified at reference numeral 10. The air intake system 10 is configured to provide intake air to cylinders of the internal combustion engine (not shown) where the intake air is mixed with fuel and combusted therein.

In one example implementation, the air intake system 10 generally includes an air intake passage 12 coupled to one end of a manifold or plenum chamber 14. A plurality of intake runners 16 are coupled to plenum chamber 14 and extend therefrom. Each intake runner 16 includes a first end 18 coupled to the plenum chamber 14, and a second end 20 configured to couple to the engine. Intake runners 16 are configured to receive intake air from the intake passage 12 and plenum chamber 14, and provide the intake air to individual combustion chambers (not shown) for the cylinders of the engine.

As shown in FIG. 1, air intake system 10 includes an independent resonator system 30 having a plurality of individual resonator assemblies 32 each associated with and coupled to one individual intake runner 16. Each individual resonator assembly 32 is tuned or designed to reduce sound/pressure waves generated by the engine and thus reduce intake noise of the internal combustion engine. Additionally, resonator assemblies 32 may be tuned to boost cylinder volumetric efficiency resulting in a boost in engine torque for higher performance. Accordingly, resonator assemblies 32 are tuned or designed target a narrow band of engine speed (RPM) range and improve engine torque at that targeted speed range.

In the illustrated example, independent resonator system 30 includes a first set of individual resonator assemblies 32 coupled to and located at intake runner first ends 18, and a second set of individual resonator assemblies 32 coupled to and located at intake runner second ends 20. In this way, the first set of individual resonator assemblies 32 are tuned for sound/pressure wave frequencies at a first engine speed range, and the second set of individual resonator assemblies 32 are tuned for sound/pressure wave frequencies at a second engine speed range. Accordingly, independent resonator system 30 can reduce engine intake noise for two separate speed ranges. In alternative arrangements, a first set of individual resonator assemblies 32 are located at intake runner first ends 18 and are tuned for NVH, while a second set of individual resonator assemblies 32 are located at intake runner second ends 20 and are tuned for performance (e.g., engine torque boost).

However, it will be appreciated that independent resonator system 30 can include any number of sets of individual resonator assemblies 32 (e.g., one or three sets). Moreover, in the illustrated example, each set of individual resonator assemblies includes one individual resonator assembly 32 per intake runner 16. However, it will be appreciated that each set of individual resonator assemblies can have any number of individual resonator assemblies 32 for a given number of intake runners 16. For example, only two individual resonator assemblies 32 may be coupled to a set of four intake runners 16 (i.e., two intake runners 16 are not coupled to an individual resonator assembly 32). Such an arrangement may be utilized, for example, to create a particular sound signature for the engine.

With further reference to FIGS. 2-5, each individual resonator assembly 32 may be one particular type of individual resonator assembly. More specifically, in the example embodiments, individual resonator assembly 32 may be a passive resonator assembly 40 (FIG. 2), an active resonator assembly 42 (FIG. 3), an active lumped resonator assembly 44 (FIG. 4), a multi-volume active lumped resonator assembly 46 (FIG. 5), or any combination thereof.

Figure 2:
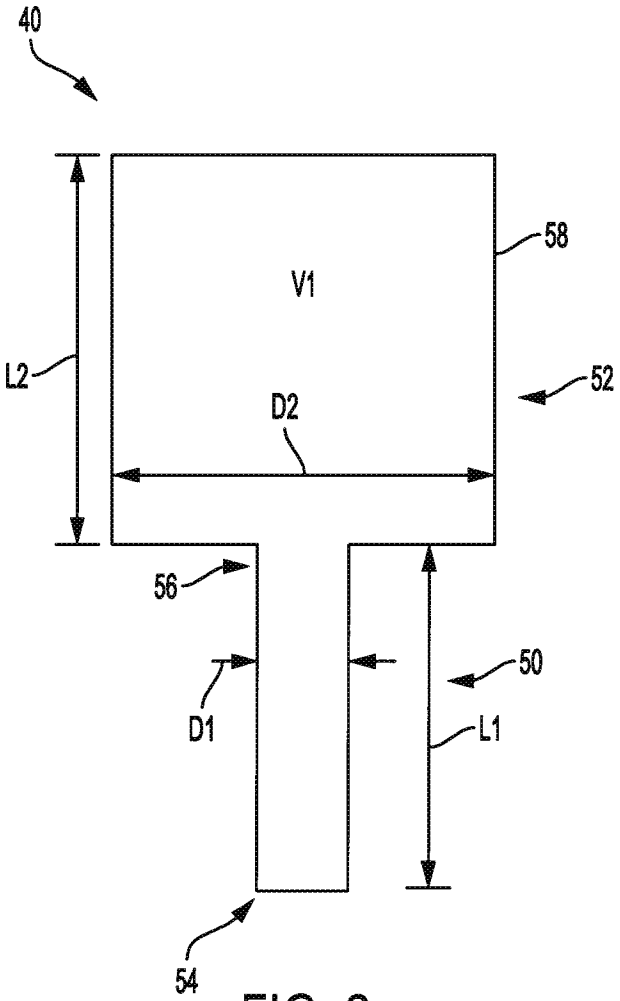
FIG. 2 is a schematic diagram of an example passive resonator assembly that may be used with the system shown in FIG. 1, in accordance with the principles of the present disclosure.

Turning now to FIG. 2, passive resonator assembly 40 will be described in more detail. As illustrated, each passive resonator assembly 40 generally includes a neck portion 50 and a chamber portion 52. Neck portion 50 includes a first end 54 and an opposite second end 56. First end 54 is configured to couple to an intake runner 16, and second end 56 is coupled to chamber portion 52. Neck portion 50 is defined by a length L1 and a diameter D1. Chamber portion 52 includes an outer wall 58 having a length L2 and a diameter D2 defining an inner volume V1 in fluid communication with the neck portion 50. Passive resonator assembly 40 does not include any moving parts and thus acts as a passive resonator for its associated intake runner 16.

In the example embodiment, lengths L1, L2 and diameters D1, D2 are tunable (i.e., variable) to provide passive resonator assembly 40 with the ability to cancel intake noise at a particular resonant frequency. In one example, the resonator frequency can be calculated as $$f = \frac{v}{2x}\sqrt{\frac{A}{V \cdot L}},$$

where v is speed of sound in air, A is the cross sectional area of the neck opening, L is the neck length, and V is the resonator volume. In this way, each passive resonator assembly 40 is tunable to the frequency of a particular sound and/or pressure wave generated by the engine at a particular engine speed, which facilitates improving engine performance and NVH. Since different engines will generate different sound/pressure waves based on the engine's characteristics, each passive resonator assembly 40 can be tuned/designed for the specific engine that it will be associated with.

With continued reference to FIG. 1, passive resonator assembly 40 may be coupled to intake runner 16 at any point between intake runner first end 18 and intake runner second end 20. However, locating passive resonator assembly 40 closer to the engine valve (i.e., closer to second end 20) enables passive resonator assembly 40 to more quickly dampen any intake noise generated by and emanating from the associated engine valve. Moreover, locating an individual passive resonator assembly 40 on the intake runner 16 enables the chamber volume V1 to be significantly reduced in size compared to known resonators for vehicle engines located upstream of the intake manifold.

Figure 3:
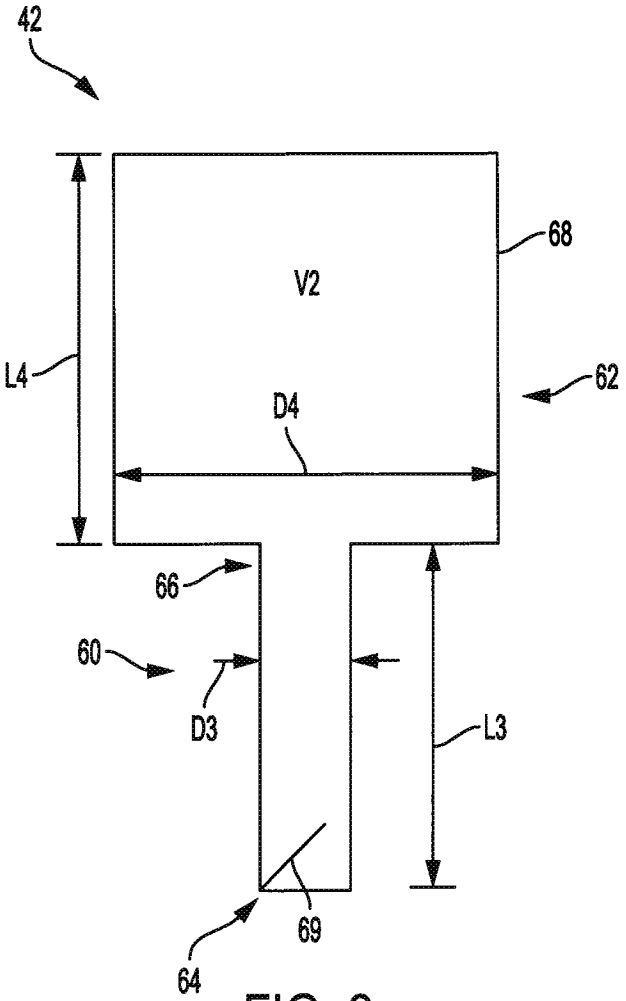
FIG. 3 is a schematic diagram of an example active resonator assembly that may be used with the system shown in FIG. 1, in accordance with the principles of the present disclosure.

Turning now to FIG. 3, active resonator assembly 42 will be described in more detail. As illustrated, each active resonator assembly 42 generally includes a neck portion 60 and a chamber portion 62. Neck portion 60 includes a first end 64, an opposite second end 66. First end 64 is configured to couple to one intake runner 16, and second end 66 is coupled to chamber portion 62. Neck portion 60 is defined by a length L3 and a diameter D3. Chamber portion 62 includes an outer wall 68 having a length L4 and a diameter D4 defining an inner volume V2 in fluid communication with the neck portion 60.

Active resonator assembly 42 is similar to passive resonator assembly 40 except that active resonator assembly 42 includes a flapper or valve 69 configured to selectively open and close to establish or prevent fluid communication between intake runner 16 and chamber volume V2. In this way, active resonator assembly 42 can be activated (e.g., valve 69 opened) to dampen sound/pressure waves traveling through intake runner 16 at a specific engine speed or speed range. The active resonator assembly 42 can then be deactivated (e.g., valve 69 closed) during another specific engine speed or speed range in order to, for example, eliminate any negative resonance effect on engine performance and/or NVH at that speed (e.g., when the resonator is not tuned for that speed).

Similar to other embodiments described herein, lengths L3, L4 and diameters D3, D4 are tunable (i.e., variable) to provide active resonator assembly 42 with the ability to cancel intake noise at a particular resonant frequency. In this way, each active resonator assembly 42 is tunable to the frequency of a particular sound/pressure wave generated by the engine at a particular engine speed, which facilitates improving engine performance and NVH. Since different engines will generate different sound/pressure waves based on the engine's characteristics, each active resonator assembly 42 can be tuned/designed for the specific engine that it will be associated with.

Although FIG. 1 illustrates passive resonator assemblies 40, air intake system 10 may alternatively or additionally utilize one or more active resonator assemblies 42. For example, the active resonator assembly 42 is coupleable to intake runner 16 at any point between intake runner first end 18 and intake runner second end 20. However, locating active resonator assembly 42 closer to the engine valve (i.e., closer to second end 20) enables active resonator assembly 42 to more quickly dampen any intake noise generated by and emanating from the associated engine valve. Moreover, locating an individual active resonator assembly 42 on the intake runner 16 enables the chamber volume V2 to be significantly reduced in size compared to known resonators for vehicle engines located upstream of the intake manifold.

Figure 4:
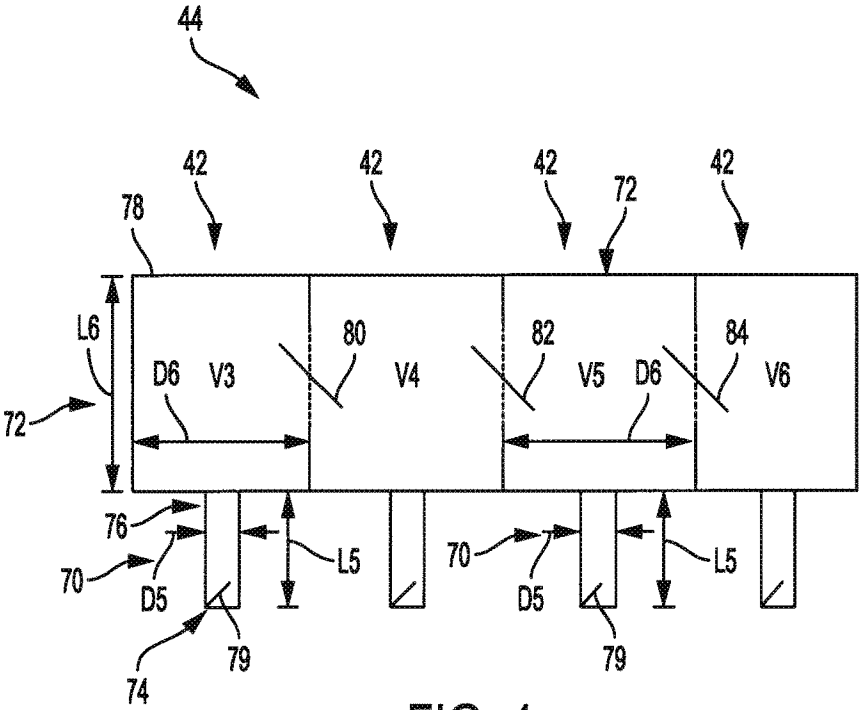
FIG. 4 is a schematic diagram of an example active lumped resonator assembly that may be used with the system shown in FIG. 1, in accordance with the principles of the present disclosure.

Turning now to FIG. 4, active lumped resonator assembly 44 will be described in more detail. As illustrated, each active lumped resonator assembly 44 generally includes a plurality of active resonator assemblies 42 coupled to each other in series and selectively fluidly connected by an active resonator valve 80, 82, 84. Although FIG. 4 illustrates active lumped resonator assembly 44 as having four integral or adjacent active resonator assemblies 42, active lumped resonator assembly 44 may have any number of integral or adjacent active resonator assemblies 42 that enables system 10 to function as described herein.

Each active resonator assembly 42 includes a neck portion 70 and a chamber portion 72. Neck portion 70 includes a first end 74 and an opposite second end 76. First end 74 is configured to couple to one intake runner 16, and second end 66 is coupled to chamber portion 72. Neck portion 70 is defined by a length L5 and a diameter D5. Chamber portion 72 includes an outer wall 78 having a length L6 and a diameter D6 defining an inner volume in fluid communication with the neck portion 70. As shown, the active resonator assemblies 42 define adjacent inner volumes V3, V4, V5, and V6. Inner volumes V3 and V4 are selectively fluidly coupled via active resonator valve 80, inner volumes V4 and V5 are selectively fluidly coupled via active resonator valve 82, and inner volumes V5 and V6 are selectively fluidly coupled via active resonator valve 84.

Each active resonator assembly 42 includes a flapper or valve 79 configured to selectively open and close to establish or prevent fluid communication between intake runner 16 and its associated chamber volume V3, V4, V5, or V6. In this way, each active resonator assembly 42 can be activated (e.g., valve 79 opened) to dampen sound/pressure waves traveling through intake runner 16 at a specific engine speed or speed range. The active resonator assembly 42 can then be deactivated (e.g., valve 79 closed) during another specific engine speed or speed range in order to, for example, eliminate any negative resonance effect on engine performance and/or NVH at that speed. As such, the system may be operated to dynamically change the total resonance volume by combining chamber volumes V2, V4, V5, and/or V6, thereby resulting in expanded ranges of engine speed for which engine performance and NVH is tuned.

Moreover, one or more active resonator valves 80, 82, 84 can be activated (e.g., opened) to establish a new volume (e.g., V3+V4) that is configured to increase air flow rate and/or dampen sound/pressure waves traveling through intake runner 16 at another specific engine speed or speed range. In this way, active lumped resonator assembly 44 is configured to provide multiple volumetric arrangements to dampen or cancel sound/pressure waves at multiple engine speeds or speed ranges.

Moreover, similar to other embodiments described herein, lengths L5, L6 and diameters D5, D6 are tunable (i.e., variable) to provide each active resonator assembly 42 with the ability to cancel intake noise at a particular resonant frequency. In this way, each active resonator assembly 42 is tunable to the frequency of a particular sound/pressure wave generated by the engine at a particular engine speed, which facilitates improving engine performance and NVH. Since different engines will generate different sound/pressure waves based on the engine's characteristics, each active resonator assembly 42 can be tuned/designed for the specific engine that it will be associated with.

Although not shown, active lumped resonator assembly 44 is coupleable to a plurality of intake runners 16 at any point between the intake runner first ends 18 and the intake runner second ends 20. However, locating active lumped resonator assembly 44 closer to the engine valve (i.e., closer to second ends 20) enables active lumped resonator assembly 44 to more quickly dampen any intake noise generated by and emanating from the associated engine valve. Moreover, locating the active lumped resonator assembly 44 on the intake runner 16 enables the chamber volumes V3, V4, V5, V6 to be significantly reduced in size compared to known resonators for vehicle engines located upstream of the intake manifold.

Figure 5:
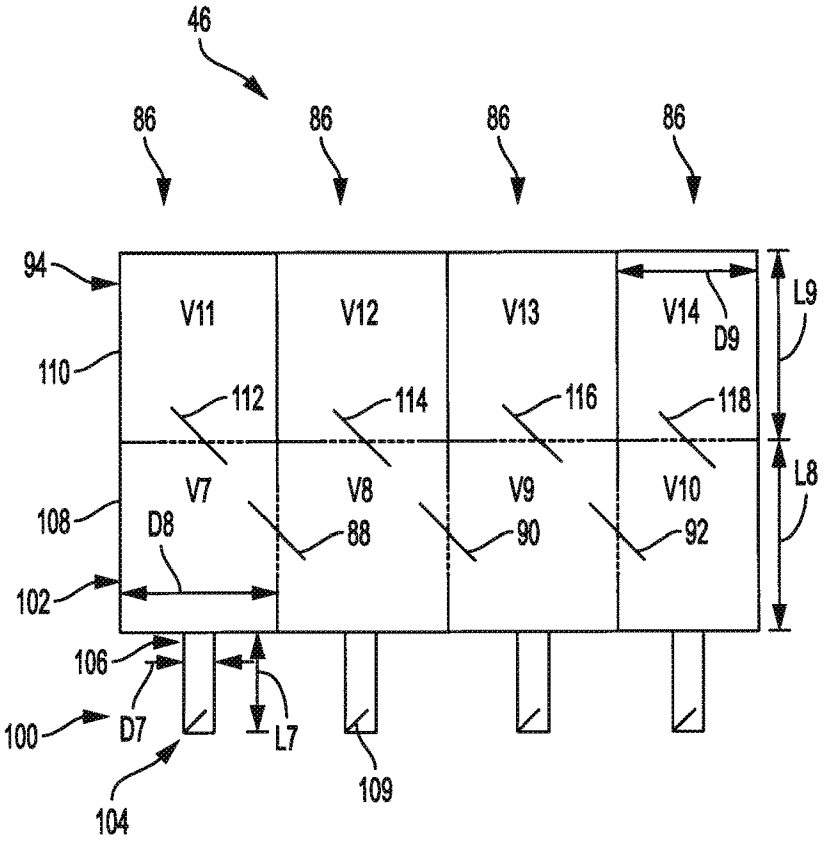
FIG. 5 is a schematic diagram of an example multi-volume active lumped resonator assembly that may be used with the system shown in FIG. 1, in accordance with the principles of the present disclosure.

Turning now to FIG. 5, multi-volume active lumped resonator assembly 46 will be described in more detail. As illustrated, each the multi-volume active lumped resonator assembly 46 generally includes a plurality of active resonator assemblies 86 coupled to each other and selectively fluidly connected by an active resonator valve 88, 90, 92. Moreover, each active resonator assembly 86 includes a secondary resonator chamber 94. Although FIG. 5 illustrates multi-volume active lumped resonator assembly 46 as having four integral or adjacent active resonator assemblies 86, multi-volume active lumped resonator assembly 46 may have any number of integral or adjacent active resonator assemblies 86 that enables system 10 to function as described herein.

Each active resonator assembly 86 includes a neck portion 100, a first chamber portion 102, and the second chamber portion 94. Neck portion 100 includes a first end 104, an opposite second end 106. First end 104 is configured to couple to one intake runner 16, and second end 106 is coupled to first chamber portion 102. Neck portion 100 is defined by a length L7 and a diameter D7. First chamber portion 102 includes an outer wall 108 having a length L8 and a diameter D8 defining an inner volume in fluid communication with the neck portion 100. As shown, the first chamber portions 102 define adjacent inner volumes V7, V8, V9, and V10. Inner volumes V7 and V8 are selectively fluidly coupled via active resonator valve 88, inner volumes V8 and V9 are selectively fluidly coupled via active resonator valve 90, and inner volumes V9 and V10 are selectively fluidly coupled via active resonator valve 92.

Each active resonator assembly 86 includes a flapper or valve 109 configured to selectively open and close to establish or prevent fluid communication between intake runner 16 and its associated chamber volume V7, V8, V9, V10. In this way, each active resonator assembly 86 can be activated (e.g., valve 109 opened) to dampen sound/pressure waves traveling through intake runner 16 at a specific engine speed or speed range. The active resonator assembly 86 can then be deactivated (e.g., valve 109 closed) during another specific engine speed or speed range in order to, for example, eliminate any negative resonance effect on engine performance and/or NVH at that speed.

Second chamber portion 94 includes an outer wall 110 having a length L9 and a diameter D9 defining an inner volume in fluid communication with the first chamber portion 102. As shown, the second chamber portions 94 define inner volumes V11, V12, V13, and V14. Inner volumes V7 and V11 are selectively fluidly coupled via a multi-volume active resonator valve 112, inner volumes V8 and V12 are selectively fluidly coupled via a multi-volume active resonator valve 114, inner volumes V9 and V13 are selectively fluidly coupled via a multi-volume active resonator valve 116, and inner volumes V10 and V14 are selectively fluidly coupled via a multi-volume active resonator valve 118.

Moreover, one or more active resonator valves 88, 90, 92 can be activated (e.g., opened) to establish a new volume (e.g., V7+V8) that is configured to increase air flow rate and/or dampen sound/pressure waves traveling through intake runner 16 at another specific engine speed or speed range. Additionally, one or more active resonator valves 112, 114, 116, 118 can be activated (e.g., opened) to establish yet another new volume (e.g., V7+V11) that is configured to increase air flow rate and/or dampen sound/pressure waves travelling through intake runner 16 at yet another specific engine speed or speed range. In this way, multi-volume active lumped resonator assembly 46 is configured to provide multiple volumetric arrangements to increase air flow rate and/or dampen or cancel sound/pressure waves at multiple engine speeds or speed ranges.

Moreover, similar to other embodiments described herein, lengths L7, L8, L9 and diameters D7, D8, D9 are tunable (i.e., variable) to provide multi-volume active lumped resonator assembly 46 with the ability to cancel intake noise at a particular resonant frequency. In this way, multi-volume active lumped resonator assembly 46 is tunable to the frequency of multiple particular sound/pressure waves generated by the engine at multiple engine speeds or speed ranges, which facilitates improving engine performance and NVH. Since different engines will generate different sound/pressure waves based on the engine's characteristics, each multi-volume active lumped resonator assembly 46 can be tuned/designed for the specific engine that it will be associated with.

Although not shown, multi-volume active lumped resonator assembly 46 is coupleable to a plurality of intake runners 16 at any point between the intake runner first ends 18 and the intake runner second ends 20. However, locating multi-volume active lumped resonator assembly 46 closer to the engine valve (i.e., closer to second ends 20) enables multi-volume active lumped resonator assembly 46 to more quickly dampen any intake noise generated by and emanating from the associated engine valve. Moreover, locating the multi-volume active lumped resonator assembly 46 on the intake runners 16 enables the chamber volumes V7-V14 to be significantly reduced in size compared to known resonators for vehicle engines located upstream of the intake manifold.

Described herein are system and methods for dampening or canceling engine noise at particular engine speeds. An independent resonator system includes one or more individual resonator assemblies each coupled to one intake runner of an engine's air intake system. The resonator assembly can be a passive resonator assembly, an active resonator assembly, an active lumped resonator assembly, and/or a multi-volume active lumped resonator assembly. In some embodiments, resonator chambers of adjacent resonator assemblies are selectively fluidly coupled by a valve to enable a plurality of resonator assemblies to selectively adjust the overall resonator chamber volume to reduce or eliminate sound/pressure waves generated by the engine. In this way, the independent resonator system enables reduced resonator chamber volumes and increased engine performance (e.g., engine torque). Accordingly, the independent resonator system can target one or more bands of speed ranges to reduce engine noise, reduce resonator volume(s), reduce costs, and increase engine performance.

It should be understood that the mixing and matching of features, elements and/or functions between various examples may be expressly contemplated herein so that one skilled in the art would appreciate from the present teachings that features, elements and/or functions of one example may be incorporated into another example as appropriate, unless described otherwise above.

What is claimed is:

1. An air intake system for an internal combustion engine, the system comprising:

a plurality of intake runners configured to supply intake air to the engine; and an independent resonator system operably associated with the plurality of intake runners and including a plurality of individual resonator assemblies, each individual resonator assembly is directly fluidly coupled to only one intake runner of the plurality of intake runners, the plurality of individual resonator assemblies configured to interact with at least one of sound and pressure waves generated in the engine to reduce engine noise and/or increase engine torque.

2. The air intake system of claim 1, wherein each individual resonator assembly is directly coupled to only one intake runner of the plurality of intake runners.

3. The air intake system of claim 1, wherein the plurality of individual resonator assemblies comprises a first set of individual resonator assemblies coupled to each intake runner of the plurality of intake runners, and a second set of individual resonator assemblies coupled to each intake runner of the plurality of intake runners, wherein the first set of individual resonator assemblies is configured to increase engine torque and/or reduce engine noise at a first range of engine speeds, and the second set of individual resonator assemblies is configured to increase engine torque and/or reduce engine noise at a second range of engine speeds that is different than the first range of engine speeds.

4. The air intake system of claim 1, further comprising a plenum chamber fluidly coupled to the plurality of intake runners and configured to supply the intake air thereto.

5. The air intake system of claim 4, further comprising an air intake passage fluidly coupled to the plenum chamber and configured to supply the intake air thereto.

6. The air intake system of claim 1, wherein the plurality of individual resonator assemblies comprises a plurality of passive resonator assemblies.

7. The air intake system of claim 6, wherein each passive resonator assembly comprises:

a chamber portion having an outer wall defining an inner volume; and a neck portion fluidly coupled between the chamber portion and one intake runner of the plurality of intake runners.

8. The air intake system of claim 7, wherein each intake runner of the plurality of intake runners is fluidly coupled to one passive resonator assembly of the plurality of passive resonator assemblies.

9. The air intake system of claim 1, wherein the plurality of individual resonator assemblies comprises a plurality of active resonator assemblies.

10. The air intake system of claim 9, wherein each active resonator assembly comprises:

a chamber portion having an outer wall defining an inner volume;

a neck portion fluidly coupled between the chamber portion and one intake runner of the plurality of intake runners; and a valve disposed within the neck portion and configured to move between a closed position preventing fluid communication between the intake runner and the chamber portion, and an open position enabling fluid communication between the intake runner and the chamber portion.

11. The air intake system of claim 10, wherein each intake runner of the plurality of intake runners is fluidly coupled to one active resonator assembly of the plurality of active resonator assemblies.

12. The air intake system of claim 1, wherein the plurality of individual resonator assemblies comprises an active lumped resonator assembly.

13. The air intake system of claim 12, wherein the active lumped resonator assembly comprises a plurality of active resonator assemblies fluidly coupled in series to each other, each active resonator assembly comprising:

a chamber portion having an outer wall defining an inner volume;

a neck portion fluidly coupled between the chamber portion and one intake runner of the plurality of intake runners; and a valve disposed within the neck portion and configured to move between a closed position preventing fluid communication between the intake runner and the chamber portion, and an open position enabling fluid communication between the intake runner and the chamber portion; and wherein the inner volumes of adjacent active resonator assemblies are fluidly coupled.

14. The air intake system of claim 13, wherein the active lumped resonator assembly further comprises an active resonator valve disposed between adjacent active resonator assemblies and configured to move between a closed position preventing fluid communication between the inner volumes of the adjacent active resonator assemblies, and an open position enabling fluid communication between the inner volumes of the adjacent active resonator assemblies.

15. The air intake system of claim 14, wherein each intake runner of the plurality of intake runners is fluidly coupled to one active resonator assembly of the plurality of active resonator assemblies.

16. The air intake system of claim 1, wherein the plurality of individual resonator assemblies comprises a multi-volume active lumped resonator assembly.

17. The air intake system of claim 16, wherein the multi-volume active lumped resonator assembly comprises a plurality of active resonator assemblies fluidly coupled in series to each other, each active resonator assembly comprising:

a first chamber portion having a first outer wall defining a first inner volume;

a second chamber portion having a second outer wall defining a second inner volume fluidly connected to the first inner volume;

a multi-volume resonator valve disposed between the first inner volume and the second inner volume, the multi-volume resonator valve configured to move between a closed position preventing fluid communication between the first inner volume and the second inner volume, and an open position enabling fluid communication between the first inner volume and the second inner volume;

a neck portion fluidly coupled between the first chamber portion and one intake runner of the plurality of intake runners; and an intake runner valve disposed within the neck portion and configured to move between a closed position preventing fluid communication between the intake runner and the first chamber portion, and an open position enabling fluid communication between the intake runner and the first chamber portion; and wherein the first inner volumes of adjacent active resonator assemblies are fluidly coupled.

18. The air intake system of claim 17, wherein the multi-volume active lumped resonator assembly further comprises an active resonator valve disposed between adjacent active resonator assemblies and configured to move between a closed position preventing fluid communication between the first inner volumes of the adjacent active resonator assemblies, and an open position enabling fluid communication between the first inner volumes of the adjacent active resonator assemblies.

19. The air intake system of claim 18, wherein each intake runner of the plurality of intake runners is fluidly coupled to one active resonator assembly of the plurality of active resonator assemblies.

20. An air intake system for an internal combustion engine, the system comprising:

an air intake passage;

a plenum chamber fluidly coupled to the air intake passage and configured to receive intake air therefrom;

a plurality of intake runners fluidly coupled to the plenum chamber and configured to supply the intake air to the engine; and an independent resonator system operably associated with the plurality of intake runners and including a first, second, third, and fourth set of individual resonator assemblies directly fluidly coupled to the plurality of intake runners, the individual resonator assemblies configured to interact with at least one of sound and pressure waves generated in the engine to increase engine torque and/or reduce engine noise;

wherein the first set of individual resonator assemblies comprises a plurality of passive resonator assemblies each comprising:

a chamber portion having an outer wall defining an inner volume; and a neck portion fluidly coupled between the chamber portion and one intake runner of the plurality of intake runners;

wherein the second set of individual resonator assemblies comprises a plurality of first active resonator assemblies each comprising:

a chamber portion having an outer wall defining an inner volume;

a neck portion fluidly coupled between the chamber portion and one intake runner of the plurality of intake runners; and a valve disposed within the neck portion and configured to move between a closed position preventing fluid communication between the intake runner and the chamber portion, and an open position enabling fluid communication between the intake runner and the chamber portion;

wherein the third set of individual resonator assemblies comprises an active lumped resonator assembly having a plurality of second active resonator assemblies fluidly coupled in series to each other, each second active resonator assembly comprising:

a chamber portion having an outer wall defining an inner volume;

a neck portion fluidly coupled between the chamber portion and one intake runner of the plurality of intake runners;

a valve disposed within the neck portion and configured to move between a closed position preventing fluid communication between the intake runner and the chamber portion, and an open position enabling fluid communication between the intake runner and the chamber portion;

wherein the inner volumes of adjacent second active resonator assemblies are fluidly coupled; and an active resonator valve disposed between adjacent second active resonator assemblies and configured to move between a closed position preventing fluid communication between the inner volumes of the adjacent second active resonator assemblies, and an open position enabling fluid communication between the inner volumes of the adjacent second active resonator assemblies; and wherein the fourth set of individual resonator assemblies comprises a multi-volume active lumped resonator assembly having a plurality of third active resonator assemblies fluidly coupled in series to each other, each third active resonator assembly comprising:

a first chamber portion having a first outer wall defining a first inner volume;

a second chamber portion having a second outer wall defining a second inner volume fluidly connected to the first inner volume;

a multi-volume resonator valve disposed between the first inner volume and the second inner volume, the multi-volume resonator valve configured to move between a closed position preventing fluid communication between the first inner volume and the second inner volume, and an open position enabling fluid communication between the first inner volume and the second inner volume;

a neck portion fluidly coupled between the first chamber portion and one intake runner of the plurality of intake runners;

an intake runner valve disposed within the neck portion and configured to move between a closed position preventing fluid communication between the intake runner and the first chamber portion, and an open position enabling fluid communication between the intake runner and the first chamber portion; and wherein the first inner volumes of adjacent third active resonator assemblies are fluidly coupled; and an active resonator valve disposed between adjacent third active resonator assemblies and configured to move between a closed position preventing fluid communication between the first inner volumes of the adjacent third active resonator assemblies, and an open position enabling fluid communication between the first inner volumes of the adjacent third active resonator assemblies.

* * * * *